US009307823B2

(12) United States Patent
Ishida

(10) Patent No.: US 9,307,823 B2
(45) Date of Patent: Apr. 12, 2016

(54) ROD-SHAPED COSMETIC MATERIAL FEEDING CONTAINER

(71) Applicant: TOKIWA CORPORATION, Gifu (JP)

(72) Inventor: Yukikazu Ishida, Saitama (JP)

(73) Assignee: TOKIWA CORPORATION, Gifu (JP)

( * ) Notice: Subject to any disclaimer, the term of this patent is extended or adjusted under 35 U.S.C. 154(b) by 93 days.

(21) Appl. No.: 14/263,333

(22) Filed: Apr. 28, 2014

(65) Prior Publication Data

US 2014/0341632 A1 Nov. 20, 2014

(30) Foreign Application Priority Data

May 14, 2013 (JP) ..... 2013-102187

(51) Int. Cl.
*A45D 40/04* (2006.01)
*A45D 40/06* (2006.01)
*A45D 40/20* (2006.01)

(52) U.S. Cl.
CPC ..... *A45D 40/06* (2013.01); *A45D 40/20* (2013.01); *A45D 40/205* (2013.01); *A45D 2040/208* (2013.01)

(58) Field of Classification Search
CPC ..... A45D 40/205; A45D 2040/208; A45D 40/10; A45D 40/06; A45D 40/065
USPC ..... 401/68, 75
See application file for complete search history.

(56) References Cited

U.S. PATENT DOCUMENTS 7,284,926 B2 * 10/2007 Tanaka ..... A45D 40/04 401/116
7,455,467 B2 * 11/2008 Sasaki ..... A45F 40/04 401/68
8,562,232 B2 * 10/2013 Ishida ..... A45D 40/04 401/68

FOREIGN PATENT DOCUMENTS

JP 2012-096009 5/2012

OTHER PUBLICATIONS

U.S. Appl. No. 14/309,289 to Yukikazu Ishida, filed Jun. 19, 2014.

* cited by examiner

*Primary Examiner* — Jennifer C Chiang
(74) *Attorney, Agent, or Firm* — Greenblum & Bernstein P.L.C.

(57) ABSTRACT

To provide a rod-shaped cosmetic material feeding container that can sufficiently protect a rod-shaped cosmetic material from impact acting in an axial direction. The rod-shaped cosmetic material feeding container includes a female thread part with a female thread. The female thread is screwed with a male thread of a movable body. One elastic body absorbs impact acting on the female thread part in an axial direction due to, for example, a drop. The other elastic body absorbs impact due to restoring force generated when the elastic body restores. Thus, a rod-shaped cosmetic material supported by the movable body threadably mounted on the female thread part can be sufficiently protected.

4 Claims, 9 Drawing Sheets

ROD-SHAPED COSMETIC MATERIAL FEEDING CONTAINER

TECHNICAL FIELD

The present invention relates to a rod-shaped cosmetic material feeding container that causes a rod-shaped cosmetic material to appear and disappear.

BACKGROUND ART

Conventionally, as a rod-shaped cosmetic material feeding container, there is known a technique described in the following Patent Document 1. The rod-shaped cosmetic material feeding container described in Patent Document 1 includes a front container part, a rear container part, a movable body, and a female screw member. The rear container part is mounted rotatable with respect to the front container part and immovable in an axial direction. The movable body is unrotatable around the axis line and movable in the axial direction with respect to the front container part. The movable body supports a rod-shaped cosmetic material at the distal end and includes a male thread at the outer peripheral part. The female screw member is unrotatable with respect to the rear container part around the axis line. The female screw member includes female threads at the inner peripheral part. The female thread is screwed with the male thread. When the front container part rotates relative to the rear container part, a thread engagement part constituted of the male thread and the female threads acts. This advances and retreats the movable body, thus the rod-shaped cosmetic material appears and disappears from an opening at the distal end of the container.

In particular, with the rod-shaped cosmetic material feeding container, the female screw member includes female threads and a spring part from the front side to the rear side in this order. The spring part can be expanded and contracted in the axial direction. Moreover, movement of the rear end of the spring part in the axial direction is almost blocked. Accordingly, even if an impact acts on the female screw member in any of back and forth directions in the axial direction, due to, for example, a drop, the spring part retracts by shrinking or stretches (expands and contracts) in the axial direction. Accordingly, the female threads also move back and forth in the axial direction. Accordingly, the movable body, which includes the male thread screwed with the female threads, also moves back and forth. Consequently, it is considered that an impact to the rod-shaped cosmetic material can be absorbed, and can protect the rod-shaped cosmetic material.

CITATION LIST

Patent Literature

Patent Document 1: Japanese Unexamined Patent Application Publication No 2012-96009

SUMMARY OF THE INVENTION

Problems to be Solved by the Invention

Here, as described above, with the rod-shaped cosmetic material feeding container, if an impact acts on the female screw member in the axial direction (rearward or frontward direction), the spring part retracts by shrinking or stretches to absorb this impact. However, to restore the original shape after the retraction by shrinking or stretch, the spring part stretches or retracts by shrinking lively in the opposite direction to the axial direction. Therefore, the impact due to the restoring force acts on the rod-shaped cosmetic material again. Accordingly, further enhancing protection of the rod-shaped cosmetic material has been desired.

Consequently, an object of the present invention is to provide a rod-shaped cosmetic material feeding container that can sufficiently protect the rod-shaped cosmetic material.

Solutions to the Problems

The rod-shaped cosmetic material feeding container of the present invention includes a tubular-shaped container with a front container part and a rear container part, the rear container part is mounted rotatable with respect to the front container part around an axis line and immovable in an axial direction, a movable body with a male thread at an outer peripheral part, the movable body is unrotatable around the axis line and movable in the axial direction with respect to the front container part, the movable body supports a rod-shaped cosmetic material at a distal end, a female thread part with a female thread at an inner peripheral part, the female thread part is unrotatable with respect to the rear container part around the axis line, the female thread is screwed with the male thread, a first elastic body is configured to reduce rearward movement of the female thread part in the axial direction and a second elastic body is configured to reduce frontward movement of the female thread part in the axial direction. The male thread and the female thread constitute a thread engagement part, the thread engagement part acts by relative rotation of the front container part and the rear container part, the relative rotation advancing and retreating the movable body causes the rod-shaped cosmetic material to appear and disappear from an opening at a distal end of a container, the female thread part is movable in the axial direction With the rod-shaped cosmetic material feeding container, the rod-shaped cosmetic material is supported at the distal end of the movable body. When impact acts on the female thread part with the female thread, which is screwed with the male thread of the movable body, in the axial direction, and this moves the female thread part to rearward in the axial direction, the first elastic body reduces the rearward movement of the female thread part, thus impact is absorbed. Afterwards, when the first elastic body restores the original shape, the second elastic body reduces the frontward movement of the female thread part, thus impact due to the restoring force is be absorbed. When impact acts on the female thread part in the axial direction, and this moves the female thread part to frontward in the axial direction, the second elastic body reduces the frontward movement of the female thread part, thus impact is absorbed. Afterwards, when the second elastic body restores the original shape, the first elastic body reduces the rearward movement of the female thread part, thus impact due to the restoring force is absorbed. Thus, one elastic body absorbs impact acting on the female thread part in the axial direction while the other elastic body absorbs impact due to the restoring force generated when the elastic body restores. This allows sufficiently protecting the rod-shaped cosmetic material, which is supported at the distal end of the movable body.

Here, specifically, the first and second elastic bodies that preferably provide the effects are configured as follows. Any one of the first elastic body or the second elastic body is an elastic body with a slit at a circumference surface and another elastic body is a coil spring.

There is also a constitution that the first elastic body and the second elastic body are coil springs.

Further, there is also a constitution that the first elastic body and the second elastic body are elastic bodies each having a slit at a circumference surface.

Advantageous Effects of the Invention

Thus, according to the present invention, a rod-shaped cosmetic material feeding container that can sufficiently protect the rod-shaped cosmetic material can be provided.

DESCRIPTION OF EMBODIMENTS

Figure 1:
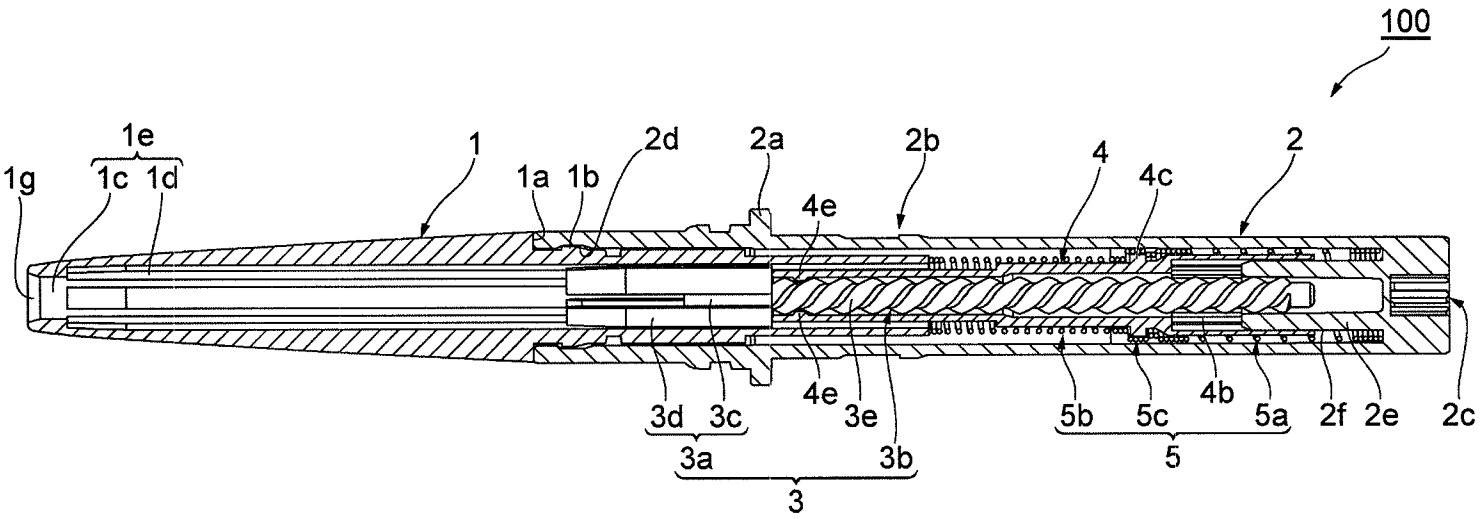
FIG. 1 is a longitudinal cross-sectional view illustrating a rod-shaped cosmetic material feeding container according to a first embodiment of the present invention.

An embodiment of a rod-shaped cosmetic material feeding container according to the present invention will be described below with reference to FIG. 1 to FIG. 9. FIG. 1 to FIG. 5 illustrate a first embodiment of the present invention. FIG. 6 to FIG. 9 illustrate a second embodiment of the present invention. The same reference numerals are attached to the same elements in the respective drawings, and an overlapping description will be omitted.

First, the first embodiment, which is illustrated in FIG. 1 to FIG. 5, will be described.

Figure 2:
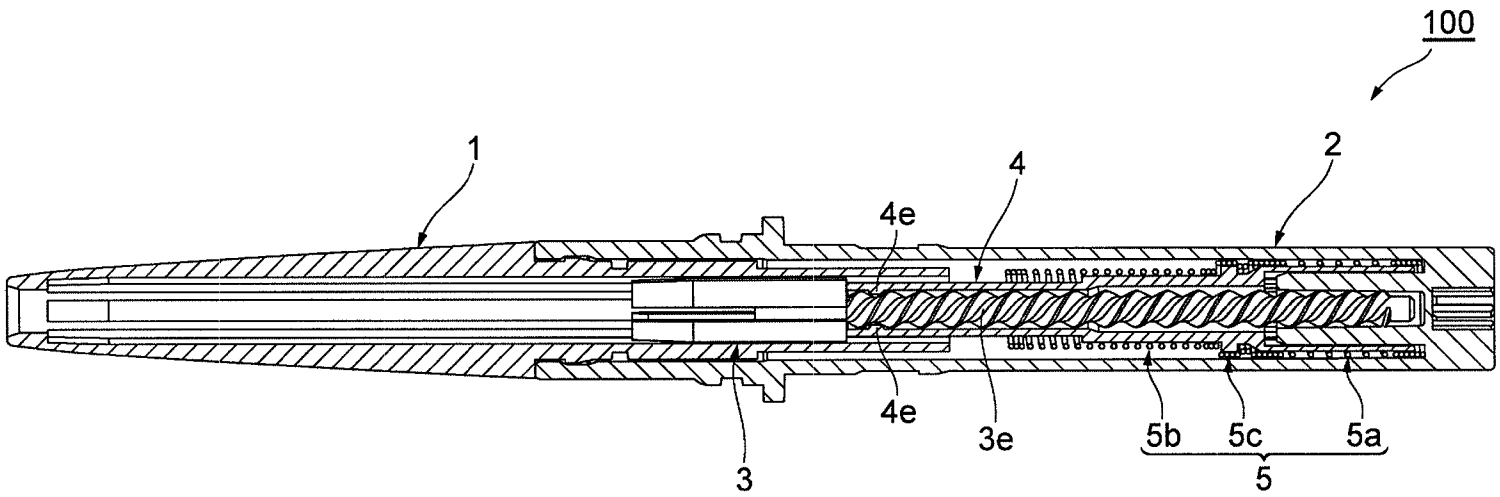
FIG. 2 is a longitudinal cross-sectional view illustrating a state where an impact is acted on a female screw member of the rod-shaped cosmetic material feeding container in FIG. 1 to rearward in the axial direction.
Figure 3:
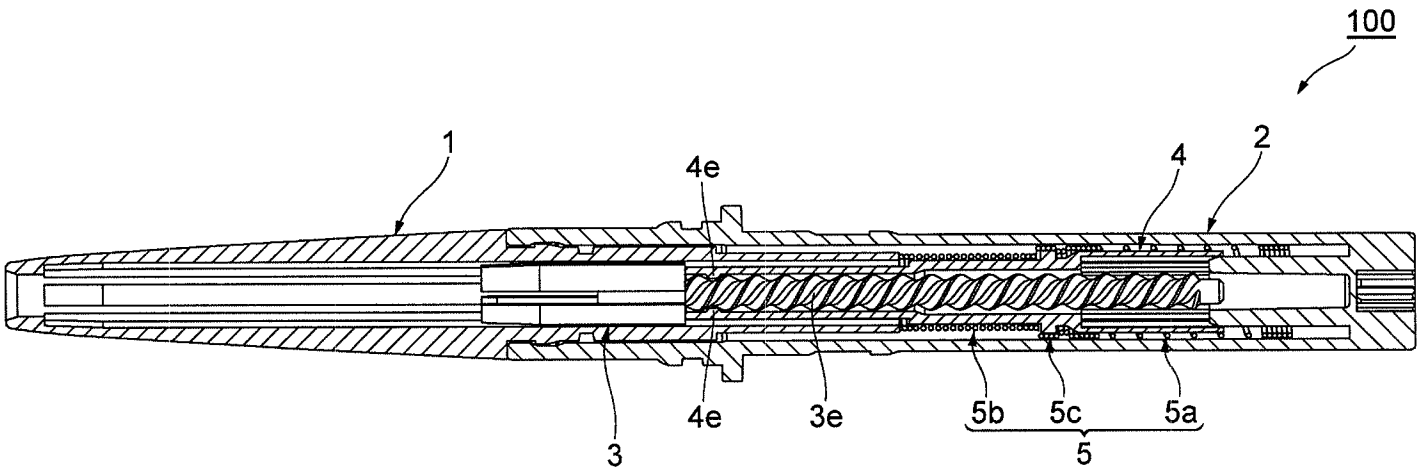
FIG. 3 is a longitudinal cross-sectional view illustrating a state where an impact is acted on the female screw member of the rod-shaped cosmetic material feeding container in FIG. 1 to frontward in the axial direction.
Figure 4:
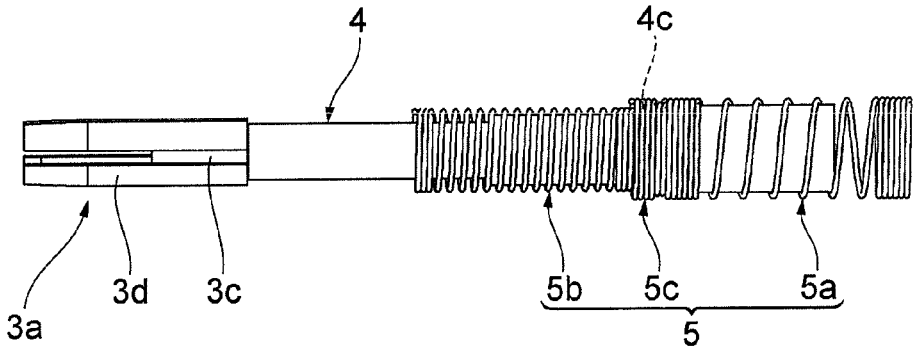
FIG. 4 is a side view illustrating a rod-shaped cosmetic material support body, coil springs, and the female screw member in FIG. 1.
Figure 5:
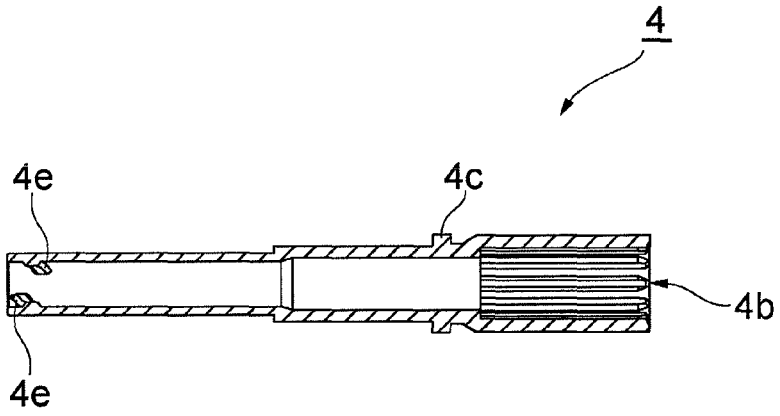
FIG. 5 is a longitudinal cross-sectional view of the female screw member in FIG. 4.

FIG. 1 is a longitudinal cross-sectional view illustrating the rod-shaped cosmetic material feeding container according to the first embodiment. FIG. 2 is a longitudinal cross-sectional view illustrating a state where an impact is acted on a female screw member of the rod-shaped cosmetic material feeding container to rearward in an axial direction. FIG. 3 is a longitudinal cross-sectional view illustrating a state where an impact is acted on the female screw member of the rod-shaped cosmetic material feeding container to frontward in the axial direction. FIG. 4 is a side view illustrating a rod-shaped cosmetic material support body, coil springs, and the female screw member. FIG. 5 is a longitudinal cross-sectional view of the female screw member. The rod-shaped cosmetic material feeding container of this embodiment houses, for example, various rod-shaped cosmetic materials such as an eye liner, an eyebrow, a lip liner, a concealer. A user can appropriately cause the cosmetic material to appear and disappear as needed. To avoid complexity of the drawings, the drawings omit a cap that covers the rod-shaped cosmetic material and a distal end of the container.

As illustrated in FIG. 1, a rod-shaped cosmetic material feeding container 100 is referred to as a so-called rod-shaped cosmetic material cartridge. The rod-shaped cosmetic material feeding container 100 has a rounded bar shape whose overall shape is elongate like a writing material. The rod-shaped cosmetic material feeding container 100 is mounted to be removably attachable (or undetachably) at one end side of a cartridge accommodating container (not illustrated) for use.

The rod-shaped cosmetic material feeding container 100 is a tubular-shaped container that includes a leading tube 1 and a main body cylinder 2. The leading tube 1 constitutes a front container part. The main body cylinder 2 constitutes a rear container part. The leading tube 1 and the main body cylinder 2 house a rod-shaped cosmetic material, a rod-shaped cosmetic material support body 3, a female screw member 4, and further an elastic body 5 as a shock-absorbing member. The rod-shaped cosmetic material support body 3 is a movable body that supports the rod-shaped cosmetic material. The female screw member 4 constitutes a thread engagement part (a thread engagement mechanism). Here, the elastic body 5 is constituted as a coil spring.

The main body cylinder 2 has a closed-bottomed cylindrical shape. A rear side with respect to a flange part 2*a*, which is disposed at an outer peripheral surface, becomes an interpolation part to be inward inserted to the cartridge accommodating container. In the outer peripheral surface at the rear side with respect to the flange part 2*a*, a concavo-convex part 2*b* is disposed. The concavo-convex part 2*b* includes an annular-shaped concave part and a convex part. The concave part and the convex part are arranged side by side in this order toward rearward in the axial direction. The concavo-convex part 2*b* causes the main body cylinder 2 to engage the cartridge accommodating container in the axial direction. The main body cylinder 2 includes a concave part at the rear end surface. The concave part has a circular shape in cross section and is depressed to the distal end side. A knurling 2*c* is disposed at the inner peripheral surface of the concave part. The knurling 2*c* includes unevennesses densely arranged side by side along the circumferential direction. The knurling 2*c* extends in the axial direction at a predetermined length. The knurling 2*c* engages the cartridge accommodating container in the rotation direction. In the inner peripheral surface at the front side with respect to the flange part 2*a* of the main body cylinder 2, an annular-shaped concave part 2*d* is disposed. The concave part 2*d* engages the leading tube 1 in the axial direction. In the inner surface of the bottom part of the main body cylinder 2, a cylindrically-shaped projecting part 2*e* is disposed. The projecting part 2*e* projects to the distal end side. A knurling 2*f* is disposed at the outer peripheral surface of the projecting part 2*e*. The knurling 2*f* includes unevennesses densely arranged side by side along the circumferential direction. The knurling 2*f* extends in the axial direction at a predetermined length. The knurling 2*f* engages the female screw member 4 in the rotation direction.

As illustrated in FIG. 5, the female screw member 4 is constituted to have a stepped cylindrical shape. The female screw member 4 includes a pair of screw projections 4*e* at the distal end sides of the inner peripheral surface. The pair of screw projections 4*e* function as a female thread that constitutes one of a thread engagement part. The female screw member 4 also includes a knurling 4*b* at the rear part side of the inner peripheral surface. The knurling 4*b* engages the knurling 2*f* of the main body cylinder 2 in the rotation direction.

An annular-shaped convex part 4*c* is disposed at the outer peripheral surface of the female screw member 4 at a rear side position with respect to the middle of the axial direction. The convex part 4*c* locks the coil spring 5 (details will be described later).

The female screw member 4 is inward inserted to the distal end side of the main body cylinder 2 from the rear end part of the female screw member 4 as illustrated in FIG. 1. The knurling 4*b* engages the knurling 2*f* of the main body cylinder 2 in the rotation direction. Thus, the female screw member 4 is mounted unrotatably with respect to the main body cylinder 2 around the axis line and movable in the axial direction (synchronously rotatable).

The leading tube 1 is constituted to have a stepped cylindrical shape with a stepped part 1*a* at the middle of the outer peripheral surface in the axial direction. A cylinder part with a small diameter continuous from the stepped part 1*a* to the rear side serves as the interpolation part inward inserted to the main body cylinder 2. A cylinder part with a large diameter continuous from the stepped part 1*a* to the front side and is tapered off to the distal end becomes a knob that projects from the distal end of the main body cylinder 2 and pinched by the user. At the outer peripheral surface at the rear side with respect to the stepped part 1*a* of the leading tube 1, an annular-shaped convex part 1*b* is disposed. The convex part 1*b* engages the annular-shaped concave part 2*d* of the main body cylinder 2 in the axial direction.

The leading tube 1 includes a rod-shaped cosmetic material hole 1*c*, a support piece groove 1*d*, and an advancing-retreating hole 1*e*. The rod-shaped cosmetic material hole 1*c* passes through from an opening 1*g* at the distal end to the rear end to allow the rod-shaped cosmetic material to slide. The support piece groove 1*d* houses a support piece 3*d* of the rod-shaped cosmetic material support body 3, which will be described later, at a plurality of positions (here, four uniformly arranged positions) around the rod-shaped cosmetic material hole 1*c* across from near the opening 1*g* to the rear end to allow sliding. The support piece groove 1*d* is installed consecutively to the rod-shaped cosmetic material hole 1*c*. The rod-shaped cosmetic material hole 1*c* and the support piece groove 1*d* constitute the advancing-retreating hole 1*e* where the rod-shaped cosmetic material and the support piece 3*d* slide.

The leading tube 1 is inward inserted from the interpolation part to the distal end side of the main body cylinder 2. The stepped part 1*a* bumps into a top end surface of the main body cylinder 2. The convex part 1*b* engages the concave part 2*d* of the main body cylinder 2 in the axial direction. Thus, the leading tube 1 is mounted rotatable around the axis line and immovable in the axial direction with respect to the main body cylinder 2. In view of this, the leading tube 1 is also rotatable with respect to the female screw member 4 around the axis line.

The rod-shaped cosmetic material support body 3 includes a support part 3*a* and a shaft body part 3*b*. The support part 3*a* supports the rear end part of the rod-shaped cosmetic material. The shaft body part 3*b* is disposed at the rear side with respect to the support part 3*a*. The shaft body part 3*b* is a shaft body extending in the axial direction and includes a male thread 3*e* at the outer peripheral surface. The male thread 3*e* constitutes the other side of the thread engagement part and extends in the axial direction. The support part 3*a* includes a base part 3*c* and support pieces 3*d*. The base part 3*c* has an outer shape approximately matches the outer shape of the rod-shaped cosmetic material. The rear end surface of the rod-shaped cosmetic material is bumped into the base part 3*c*. The support pieces 3*d* are disposed at a plurality of positions (here, four uniformly arranged positions) at the outer peripheral surface of the base part 3*c* in the circumferential direction and project toward the distal end side. The support pieces 3*d* sandwich the rear end part of the rod-shaped cosmetic material bumped into the base part 3*c* between them for support.

The rod-shaped cosmetic material support body 3 is inward inserted from the distal end side to the rear end side of the leading tube 1. The base part 3*c* advances the rod-shaped cosmetic material hole 1*c* of the leading tube 1. The support piece 3*d* advances the support piece groove 1*d* of the leading tube 1. Thus, the rod-shaped cosmetic material support body 3 is inward inserted to the advancing-retreating hole 1*e*. Accordingly, the support piece groove 1*d* to which the support piece 3*d* of the rod-shaped cosmetic material support body 3 advances serves as a rotation stopper for the rod-shaped cosmetic material support body 3. The rod-shaped cosmetic material support body 3 is mounted unrotatably around the axis line and movable in the axial direction with respect to the leading tube 1. In this state, the shaft body part 3*b* of the rod-shaped cosmetic material support body 3 enters the inside of the female screw member 4. Thus, the male thread 3*e* threadably mounted on the screw projection 4*e* of the female screw member 4.

The coil spring 5 as the elastic body is a compression coil spring. Here, the coil spring 5 is made of SUS. As illustrated in FIG. 1 and FIG. 4, the coil spring 5 is disposed so as to surround (winds around) the female screw member 4. The coil spring 5 includes a first coil spring 5*a* at a rear half part and a second coil spring 5*b* at a front half part. The first coil spring 5*a* is a first elastic body that roughly wounds around the female screw member 4. The second coil spring 5*b* is a second elastic body that is continuous from the first coil spring 5*a* and densely wounds around the female screw member 4. Thus roughly and densely wounding the female screw member 4 changes spring constants of the first and second coil springs 5*a* and 5*b* with one another.

A boundary 5*c* between the first coil spring 5*a* and the second coil spring 5*b* of the coil spring 5 is disposed so as to be wound correspondingly around the convex part 4*c* at the outer peripheral surface of the female screw member 4. That is, parts of the boundary 5*c* of the coil spring 5 at the front side and the rear side with respect to the convex part 4*c* of the female screw member 4 contact the respective front side surface and the rear side surface of the convex part 4*c* in the axial direction. Accordingly, the boundary 5*c* is locked with respect to the convex part 4*c* of the female screw member 4 in the axial direction.

As illustrated in FIG. 1, in the state where the rod-shaped cosmetic material support body 3 positions at a retreating limit, which is an initial position, the rear end surface of the leading tube 1 and the bottom part of the main body cylinder 2 sandwich the coil spring 5. Thus, both the first coil spring 5*a* and the second coil spring 5*b* accumulate resilient force. Therefore, the first coil spring 5*a* functions to reduce movement of the female screw member 4 rearward in the axial direction. The second coil spring 5*b* functions to reduce movement of the female screw member 4 frontward in the axial direction. In the state where the rod-shaped cosmetic material support body 3 is at the retreating limit, which is the initial position, the rear end surface of the base part 3*c* of the rod-shaped cosmetic material support body 3 contacts the top end surface of the female screw member 4.

The interpolation part of the rod-shaped cosmetic material feeding container (the rod-shaped cosmetic material cartridge) 100 thus constituted is inward inserted to the opening at the one end side of the cartridge accommodating container. The flange part 2*a* of the main body cylinder 2 contacts the end surface at the one end side of the cartridge accommodating container. The concavo-convex part 2*b* of the main body cylinder 2 engages the concavo-convex part (not illustrated) at the inner peripheral surface of the cartridge accommodating container in the axial direction. This causes the rod-shaped cosmetic material feeding container 100 removably attachable or undetachable with respect to the cartridge accommodating container in the axial direction. The knurling 2*c* of the main body cylinder 2 engages the knurling (not illustrated) of the cartridge accommodating container in the rotation direction. This allows the rod-shaped cosmetic material feeding container 100 to be unrotatably mounted with respect to the cartridge accommodating container around the axis line. That is, the rod-shaped cosmetic material cartridge 100 and the cartridge accommodating container are integrated.

Next, the following describes an act of the rod-shaped cosmetic material feeding container 100 with such constitution. When the user relatively rotates the leading tube 1, which constitutes the front container part, and the cartridge accommodating container, which constitutes the rear container part in a feed direction, which is a one direction, a screwing effect of the thread engagement part, which is formed by the male thread 3*e* of the rod-shaped cosmetic material support body 3 and the screw projection 4*e* of the female screw member 4, acts. This moves the rod-shaped cosmetic material support body 3 forward. Then, the rod-shaped cosmetic material appears and disappears from the opening 1*g* at the distal end of the leading tube 1, allowing the rod-shaped cosmetic material to be applied. Then, the first coil spring 5*a* absorbs impact acting on the rod-shaped cosmetic material in the axial direction due to pressure of applying the cosmetic material.

When the user terminates application and relatively rotates the leading tube 1 and the cartridge accommodating container in a feedback direction, which is the opposite direction to the one direction. This retreats the rod-shaped cosmetic material support body 3 and the rod-shaped cosmetic material sinks from the opening 1*g* at the distal end of the leading tube 1.

Here, the description is given with the state where the rod-shaped cosmetic material feeding container 100 is mounted to the cartridge accommodating container as the rod-shaped cosmetic material cartridge. To cause the rod-shaped cosmetic material to appear and disappear from the opening 1*g* of the leading tube 1 with the state where the rod-shaped cosmetic material feeding container 100 is removed from the cartridge accommodating container, it is only necessary to relatively rotate the leading tube 1, which constitutes the front container part, and the main body cylinder 2, which constitutes the rear container part, in the feed direction or the feedback direction.

Here, assume the case where the rod-shaped cosmetic material feeding container 100, for example, drops from the distal end side with the rod-shaped cosmetic material feeding container 100 mounted to the cartridge accommodating container or removed from the cartridge accommodating container. This impact first moves the female screw member 4 frontward in the axial direction. Then, an impact acts on the female screw member 4 rearward in the axial direction. As illustrated in FIG. 2, the female screw member 4 moves rearward in the axial direction.

In association with the movement of the female screw member 4 in the axial direction, the second coil spring 5*b* restricts the frontward movement of the female screw member 4 and absorbs (buffers) the impact. Afterwards, when the second coil spring 5*b* restores (returns to) the original shape, the first coil spring 5*a* restricts the rearward movement of the female screw member 4 and absorbs the impact (vibration) due to the restoring force.

Assume the case where the rod-shaped cosmetic material feeding container 100, for example, drops from the rear end side with the rod-shaped cosmetic material feeding container 100 mounted to the cartridge accommodating container or removed from the cartridge accommodating container. This impact first moves the female screw member 4 rearward in the axial direction. Then, an impact acts on the female screw member 4 frontward in the axial direction. As illustrated in FIG. 3, the female screw member 4 moves frontward in the axial direction.

In association with the movement of the female screw member 4 in the axial direction, the first coil spring 5*a* restricts the rearward movement of the female screw member 4 and absorbs (buffers) the impact. Afterwards, when the first coil spring 5*a* restores (returns to) the original shape, the second coil spring 5*b* restricts the frontward movement of the female screw member 4 and absorbs the impact (vibration) due to the restoring force.

Thus, in this embodiment, the female screw member 4, which is a female thread part including the screw projection 4*e*, is movable to the axial direction. The rod-shaped cosmetic material feeding container 100 includes the first coil spring 5*a* and the second coil spring 5*b*. The first coil spring 5*a* reduces rearward movement of the female screw member 4 in the axial direction. The second coil spring 5*b* reduces frontward movement of the female screw member 4 in the axial direction. One coil spring absorbs the impact acting on the female screw member 4 in the axial direction, and the other coil spring absorbs the impact due to the restoring force generated when the coil spring restores. Accordingly, the rod-shaped cosmetic material supported by the rod-shaped cosmetic material support body 3, which is screwed with the female screw member 4, can be sufficiently protected.

Both ends of the coil spring 5 are not secured to the main body cylinder 2 and the leading tube 1 here; however, both ends may be secured.

The first coil spring 5*a* and the second coil spring 5*b* may not be integrated but may be different bodies.

Figure 6:
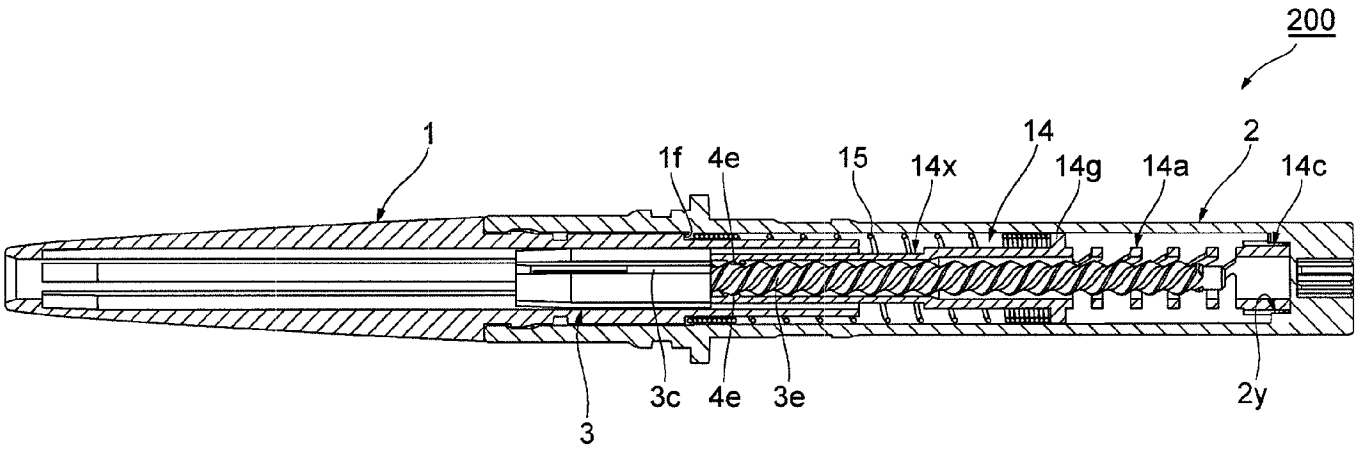
FIG. 6 is a longitudinal cross-sectional view illustrating a rod-shaped cosmetic material feeding container according to a second embodiment of the present invention.
Figure 7:
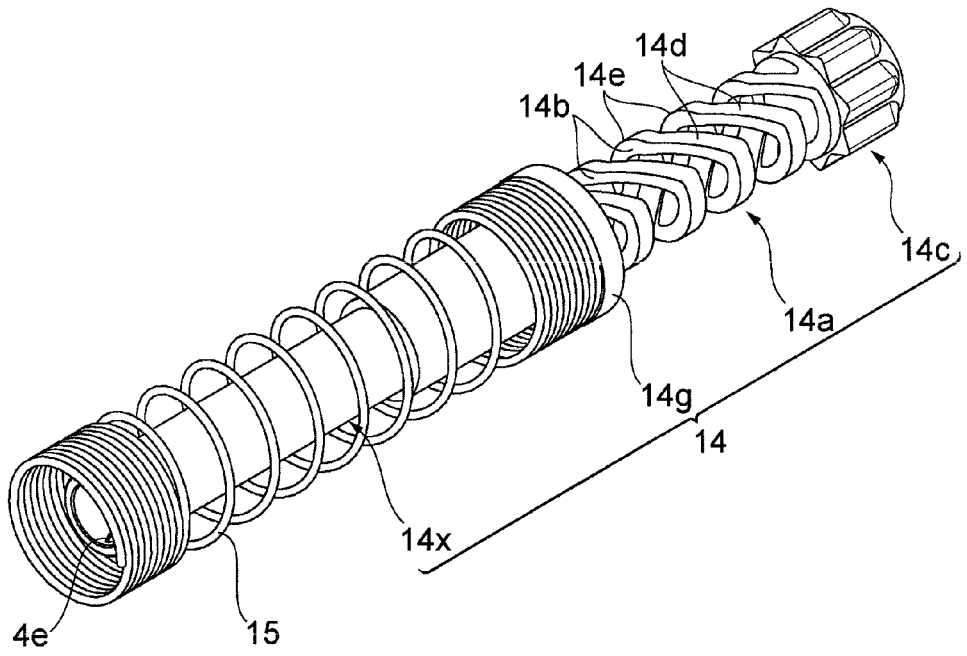
FIG. 7 is a perspective view illustrating a coil spring and the female screw member in FIG. 6.
Figure 8:
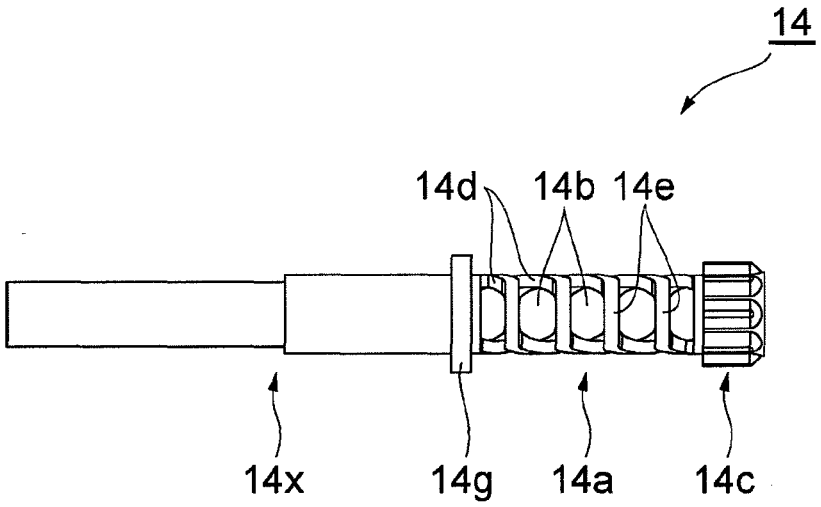
FIG. 8 is a side view of the female screw member in FIG. 7.
Figure 9:
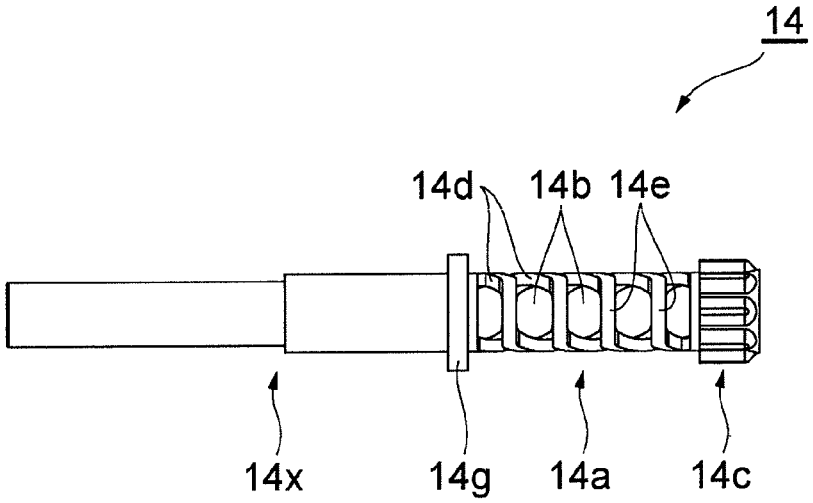
FIG. 9 is a plan view of the female screw member in FIG. 8.

FIG. 6 is a longitudinal cross-sectional view illustrating the rod-shaped cosmetic material feeding container according to a second embodiment of the present invention. FIG. 7 is a perspective view illustrating the coil spring and the female screw member. FIG. 8 is a side view of the female screw member. FIG. 9 is a plan view of the female screw member.

As illustrated in FIG. 6, the difference between a rod-shaped cosmetic material feeding container 200 of the second embodiment and the rod-shaped cosmetic material feeding container 100 of the first embodiment is that the rod-shaped cosmetic material feeding container 200 includes a female screw member 14 with a resin spring 14*a* as the first elastic body instead of the female screw member 4 of the first embodiment.

The female screw member 14 is integrally molded product made of resin. As illustrated in FIG. 6 to FIG. 9, the female screw member 14 is constituted to an approximately cylindrical shape and includes a rotation engaging part 14*c*, the resin spring 14*a*, and a female thread part 14*x* from the end side to the distal end side in this order.

The rotation engaging part 14*c* engages the main body cylinder 2 in the rotation direction. The rotation engaging part 14*c* includes a concavo-convex part. The concavo-convex part includes unevennesses that are alternately and circumferentially arranged at the outer peripheral surface of the cylinder in the axial direction at a predetermined length.

The resin spring 14*a* includes slits 14*b* in a spiral pattern and is constituted to be a double-threaded screw. The resin spring 14*a* alternately and radially includes inclined parts 14*d* and arc parts 14*e*. The inclined parts 14*d* radially incline by the slits 14*b*. The arc parts 14*e* are continuous from the inclined parts 14*d* and curve around the axis line (within the surface almost perpendicular to the axis line).

The female thread part 14*x* includes the above-described pair of screw projections 4*e* and 4*e* at the inner peripheral surface at the front side and includes a flange part 14*g* at the outer peripheral surface at the rear end part. The male thread 3*e* of the rod-shaped cosmetic material support body 3 is screwed with the pair of screw projections 4*e* and 4*e*.

In association with such changes, the main body cylinder 2 is also changed. As illustrated in FIG. 6, the projecting part 2*e*, which is at the bottom part in the first embodiment, is eliminated. The main body cylinder 2 includes a rotation engaging part 2*y* at the bottom part. The rotation engaging part 2*y* circumferentially includes a concavo-convex part. The concavo-convex part extends in the axial direction at the predetermined length and engages the concavo-convex part of the rotation engaging part 14*c* of the female screw member 14 in the rotation direction.

By the use of such female screw member 14, the above-described second elastic body surrounds the female thread part 14*x*, thus a coil spring 15 surrounding the rear end part of the leading tube 1 is formed. The coil spring 15 is wound densely at both end parts and wound roughly at the central part.

As illustrated in FIG. 6, in a state where the rod-shaped cosmetic material support body 3 is at the retreating limit, which is the initial position, the rotation engaging part 2*y* of the main body cylinder 2 and the rotation engaging part 14*c* of the female screw member 14 engage in the rotation direction. Thug, the female screw member 14 is mounted unrotatably around the axis line and movable in the axial direction with respect to the main body cylinder 2. In this state, the rear end surface of the base part 3*c* of the rod-shaped cosmetic material support body 3 contacts the top end surface of the female screw member 14.

In the state where the rod-shaped cosmetic material support body 3 is at the retreating limit, which is the initial position, the resin spring 14*a*, which is the first elastic body, accumulates resilient force between the rotation engaging part 14*c* and the female thread part 14*x*. In the state, the flange part 14*g* of the female screw member 14 and a stepped part 1*f* formed at the outer peripheral surface at the rear part of the leading tube 1 sandwich the coil spring 15, which is the second elastic body. Thus, the coil spring 15 accumulates resilient force. Accordingly, the resin spring 14*a* functions to reduce movement of the female thread part 14*x* rearward in the axial direction. The coil spring 15 functions to reduce movement of the female thread part 14*x* frontward in the axial direction.

In the second embodiment thus constituted as well, the rotation engaging part 2*y* of the main body cylinder 2 and the rotation engaging part 14*c* of the female screw member 14 engage in the rotation direction. Accordingly, the main body cylinder 2 and the female screw member 14 are unrotatable around the axis line similar to the first embodiment. Consequently, similarly to the first embodiment, relative rotation of the leading tube 1 and the main body cylinder 2 allows the rod-shaped cosmetic material to appear and disappear from the opening 1*g* of the leading tube 1.

In this second embodiment as well, assume the case where the rod-shaped cosmetic material feeding container 200, for example, drops from the distal end side. This impact first moves the female thread part 14*x* frontward in the axial direction. Then, an impact acts on the female thread part 14*x* rearward in the axial direction. The female thread part 14*x* moves rearward in the axial direction. In association with the movement of the female thread part 14*x* in the axial direction, the coil spring 15 restricts the frontward movement of the female thread part 14*x* and absorbs (buffers) the impact. Afterwards, when the coil spring 15 restores (returns to) the original shape, the resin spring 14*a* restricts the rearward movement of the female thread part 14*x* and absorbs the impact (vibration) due to the restoring force.

Assume the case where the rod-shaped cosmetic material feeding container 200, for example, drops from the rear end side. This impact first moves the female thread part 14*x* rearward in the axial direction. Then, an impact acts on the female thread part 14*x* frontward in the axial direction. The female thread part 14*x* moves frontward in the axial direction. In association with the movement of the female thread part 14*x* in the axial direction, the resin spring 14*a* restricts the rearward movement of the female thread part 14*x* and absorbs (buffers) the impact. Afterwards, when the resin spring 14*a* restores (returns to) the original shape, the coil spring 15 restricts the frontward movement of the female thread part 14*x* and absorbs the impact (vibration) due to the restoring force.

Thus, in the second embodiment as well, any one of the resin spring 14*a* or the coil spring 15 absorbs the impact acting on the female thread part 14*x* with the screw projection 4*e* in the axial direction. The other spring absorbs the impact due to the restoring force generated when the one spring restores. Accordingly, the rod-shaped cosmetic material supported by the rod-shaped cosmetic material support body 3, which is threadably mounted on the female thread part 14*x*, can be sufficiently protected.

Although the present invention has been specifically described on the basis of its embodiments; however, the present invention is not limited to the above embodiments. For example, the second embodiment uses the resin spring 14*a* as a particularly preferable first elastic body. However, the first elastic body may be made of, for example, a metal. That is, it is only necessary that the first elastic body may be an elastic body with a slit at the circumference surface.

The combinations of the first and second elastic bodies are also not limited to the combinations in the first and second embodiments. The first elastic body may be a coil spring, and the second elastic body may be an elastic body with a slit at the circumference surface. Alternatively, both the first and second elastic bodies may be elastic bodies each having a slit at the circumference surface.

It is only necessary that the male thread and the female thread work similar to a screw thread like a group of projections intermittently disposed or a group of projections spirally and intermittently disposed. Alternatively, the screw projections may be a continuous screw thread.

Further, in the embodiments an application to a cartridge type container is described. However, application to a container other than the cartridge type container is also possible.

What is claimed is:

1. A rod-shaped cosmetic material feeding container, comprising:

a tubular-shaped container with a front container part and a rear container part, the front container part being mounted rotatable with respect to the rear container part around an axis line and immovable in an axial direction;

a movable body with a male thread at an outer peripheral part, the movable body being unrotatable around the axis line and movable in the axial direction with respect to the front container part, the movable body supporting a rod-shaped cosmetic material at a distal end;

a female thread part with a female thread at an inner peripheral part, the female thread part being unrotatable with respect to the rear container part around the axis line, the female thread being screwed with the male thread;

a first elastic body that does not surround the female thread part and is configured to reduce rearward movement of the female thread part in the axial direction; and a second elastic body that surrounds the female thread part and is configured to reduce frontward movement of the female thread part in the axial direction, wherein the male thread and the female thread constitute a thread engagement part, the thread engagement part acts by relative rotation of the front container part and the rear container part, the relative rotation advancing and retreating the movable body causes the rod-shaped cosmetic material to appear and disappear from an opening at a distal end of a container, the female thread part is movable in the axial direction.

2. The rod-shaped cosmetic material feeding container according to claim 1, wherein any one of the first elastic body or the second elastic body is an elastic body having a slit at a circumference surface and another elastic body is a coil spring.

3. The rod-shaped cosmetic material feeding container according to claim 1, wherein the first elastic body and the second elastic body are coil springs.

4. The rod-shaped cosmetic material feeding container according to claim 1, wherein the first elastic body and the second elastic body are elastic bodies each having a slit at circumference surface.

* * * * *